United States Patent [19]

Henkin et al.

[11] Patent Number: 4,715,071

[45] Date of Patent: Dec. 29, 1987

[54] HYDROTHERAPY MASSAGE METHOD AND APPARATUS

[76] Inventors: Melvyn L. Henkin, 5011 Donna Ave., Tarzana, Calif. 91356; Jordan M. Laby, 3038 Bayshore, Ventura, Calif. 93001

[21] Appl. No.: 38,780

[22] Filed: Apr. 15, 1987

Related U.S. Application Data

[63] Continuation-in-part of Ser. No. 796,987, Nov. 12, 1985.

[51] Int. Cl.[4] ..... A61H 33/02; E03C 1/02

[52] U.S. Cl. ..... 4/542; 4/541; 4/492; 128/38; 128/66; 239/416; 239/429; 239/587

[58] Field of Search ..... 4/491, 492, 541–544; 128/66, 38; 239/413, 416, 416.4, 416.5, 428.5, 429, 587

[56] References Cited

U.S. PATENT DOCUMENTS

| | | | |
|---|---|---|---|
| 4,220,145 | 9/1980 | Stamp et al. | 4/542 X |
| 4,335,854 | 6/1982 | Raynoso | 4/542 X |
| 4,339,833 | 7/1982 | Mandell | 4/542 |
| 4,466,141 | 8/1984 | Starkey | 4/542 |
| 4,520,514 | 6/1985 | Johnson | 4/490 |
| 4,523,340 | 6/1985 | Walkins | 4/542 |

*Primary Examiner*—Henry K. Artis

*Attorney, Agent, or Firm*—Freilich, Hornbaker, Rosen & Fernandez

[57] ABSTRACT

A hydrotherapy method and apparatus for discharging a water stream through a rigid conduit while concurrently translating the conduit discharge orifice along a nonlinear path describing an area. The conduit is comprised of a supply section and a discharge section having an axis misaligned with the supply section axis for discharging a stream in a direction tending to rotate the conduit around the supply section axis. Frictional loading of the conduit, attributable to suction produced by the supply water jet, is mitigated by providing a passageway which permits the suction to draw tub water into a cavity for entrainment by the water jet for discharge through the conduit.

42 Claims, 16 Drawing Figures

HYDROTHERAPY MASSAGE METHOD AND APPARATUS

RELATED APPLICATIONS

This is a continuation-in-part of application Ser. No. 796,987 filed Nov. 12, 1985 whose disclosure is, by reference, incorporated herein.

BACKGROUND OF THE INVENTION

This invention relates generally to hydrotherapy and more particularly to an improved method and apparatus useful in spas, hot tubs, bathtubs, and the like for discharging a fluid (e.g.water-air) stream to impact against and massage a user's body. Applicants prior application Ser. No. 796,987 filed Nov. 12, 1985, discloses an apparatus including a conduit having a discharge orifice mounted for movement so as to cause the impacting fluid stream to sweep over an area of the user's body. Related apparatus is disclosed in applicants' pending application Ser. No. 843,151 filed Mar. 24, 1986 and Ser. No. 902,179 filed Aug. 29, 1986. The present application discloses improved structural embodiments configured to reduce friction loss and enhance conduit movement.

Other hydrotherapy devices for massaging a user's body by moving a discharge nozzle are disclosed in U.S. Pat. Nos. 4,523,340; 4,339,833; 4,220,145; and 3,868,949. Various other hydrotherapy devices for discharging water-air streams are disclosed in the following U.S. Pat. Nos. 4,502,168; 4,262,371; 3,905,358; and 3,297,025

SUMMARY OF THE INVENTION

The present invention relates to improvements in hydrotherapy and more particularly to a method and apparatus for discharging a fluid stream, while concurrently translating the stream along a path describing an area. A translating the stream along a path describing an area. A user can fixedly position his body proximate to the apparatus to enable the discharged stream to impact against and sweep over an area of the user's body.

In a preferred application of the invention, the apparatus is mounted in an opening in the perimeter wall (i.e. including floor) of a spa, hot tub, bathtub, etc., generally referred to herein as a water tub.

Apparatus in accordance with preferred embodiments of the present invention, is characterized by the use of a water-air jet assembly including a nozzle for discharging a water jet under pressure into a mixing cavity. The water jet creates a suction, via venturi action, which draws air into the cavity and the resulting water-air stream is then discharged into an elongated rigid conduit having a tubular supply section, a tubular discharge section, and a tubular intermediate section coupling said supply section to said discharge section. The tubular supply section defines a supply orifice at one end of said conduit and the tubular discharge section defines a discharge orifice at the other end of said conduit. The axis of said intermediate section deviates by an acute angle from the axis of said supply section. The supply section is mounted for rotation, and, when rotated, causes the discharge orifice to be translated along a path describing an area.

In accordance with an important characteristic of applicants' preferred embodiments, the axis of said discharge section is misaligned with the axis of said supply section to discharge a water stream from the discharge orifice in a direction including a component which produces a force on said discharge section acting to rotate said conduit around said supply section axis, or more generally, to move it along a nonlinear travel path.

The present invention is based in part on the recognition that in the event the air inlet to the mixing cavity becomes obstructed (either intentionally or inadvertently), the suction created by the water jet can act on the conduit to increase the drag, i.e. friction loss, between the conduit and its mounting means. As a result, the translation of the conduit discharge orifice may become sluggish, thus degrading the massage action of the water-air stream. Accordingly, in accordance with one aspect of the present invention, means are provided for enchancing conduit movement regardless of whether air is supplied to the mixing cavity. More specifically, in accordance with preferred embodiments of the present invention, passageway means are provided for drawing water from outside the conduit into the mixing cavity to thus mitigate the effect of the suction force acting on the conduit itself.

In accordance with a first embodiment of the present invention, the conduit supply section has an exterior ball surface which is accommodated in a mating mounting socket. First and second axially spaced annular bearing surfaces are formed in the socket such that in normal operation, the water-air stream from the jet assembly thrusts the conduit forwardly to contact the ball surface against the first, i.e. forward, annular bearing surface. If the air available to the mixing cavity diminishes sufficiently to allow the suction to pull the ball rearwardly against the second, i.e. rear, annular bearing surface, tub water from outside the conduit will be drawn past the front bearing surface into the cavity to thus mitigate the suction force on the conduit itself. In this first embodiment, the ball surface contacts and moves with respect to the bearing surfaces which provide support against both axial and lateral thrust. The ball and socket arrangement essentially defines a universal joint permitting the conduit supply section to pivot around horizontal and vertical axes and allowing the discharge orifice to translate along substantially any arbitrarily shaped path including a complex path, i.e. nonlinear and noncircular.

In accordance with a second embodiment of the present invention, the outer peripheral wall of the conduit supply section is cylindrical and is mounted for rotation around its axis within a cylindrical bushing. The stream discharge from the conduit discharge orifice produces a force which rotates the supply section around its axis and translates the conduit discharge orifice along a circular path.

In accordance with a preferred aspect of said second embodiment, the forward end of the conduit is supported by a pin substantially aligned with the supply section central axis. The pin provides support against lateral thrust (created by the discharged stream) and additionally permits the conduit to move axially. As in the aforementioned first embodiment, when suction draws the conduit to its rear axial position, tub water from outside the conduit is drawn into the mixing cavity to break the suction and avoid high frictional loading between the conduit and its bearing surfaces.

In a third embodiment, similar to said second embodiment, the outer peripheral wall of the conduit supply section is dimensioned to provide sufficient clearance (e.g. greater than 0.015 inches) relative to the bushing inner surface so as to permit tub water to be readily drawn therebetween. This water flow between the conduit supply section peripheral wall and the bushing inner surface forms a water lubricated bearing enabling the supply section to rotate with very low frictional loss.

In accordance with a more specific aspect of the third embodiment, the conduit supply section outer peripheral wall is preferably eccentrically and dimensionally configured so that it engages the bushing inner surface along a very narrow band (i.e. ideally, line contact) with the remainder of the wall periphery spaced from the bushing inner surface to permit tub water to flow therepast into the mixing cavity. The water flow, in addition to creating a water lubricated bearing, mitigates the contact force between the peripheral wall narrow band and the bushing inner surface by reducing the pressure on the side of the conduit diametrically opposite to the narrow band.

In accordance with a further aspect of the third embodiment, a forwardly projecting pin extends from the conduit substantially aligned with the axis of the conduit supply section. The pin is supported for rotation about its axis by a front grill so that the conduit is able to rotate relative to the grill to thus permit the conduit discharge orifice to translate along a circular path. The pin mounting provides support against lateral thrust produced by the stream component discharged from the conduit discharge orifice and washers associated with the pin afford support against forward axial thrust produced by the stream discharged from the jet assembly and rearward axial thrust produced by suction acting on the conduit.

In accordance with a still further aspect of the third embodiment, the grill and conduit comprise a subassembly which can be readily mounted on, and removed from, a housing mounted on the tub wall to thus provide ready access to the housing interior and jet assembly, for cleaning and maintenance.

DETAILED DESCRIPTION

Figure 1:
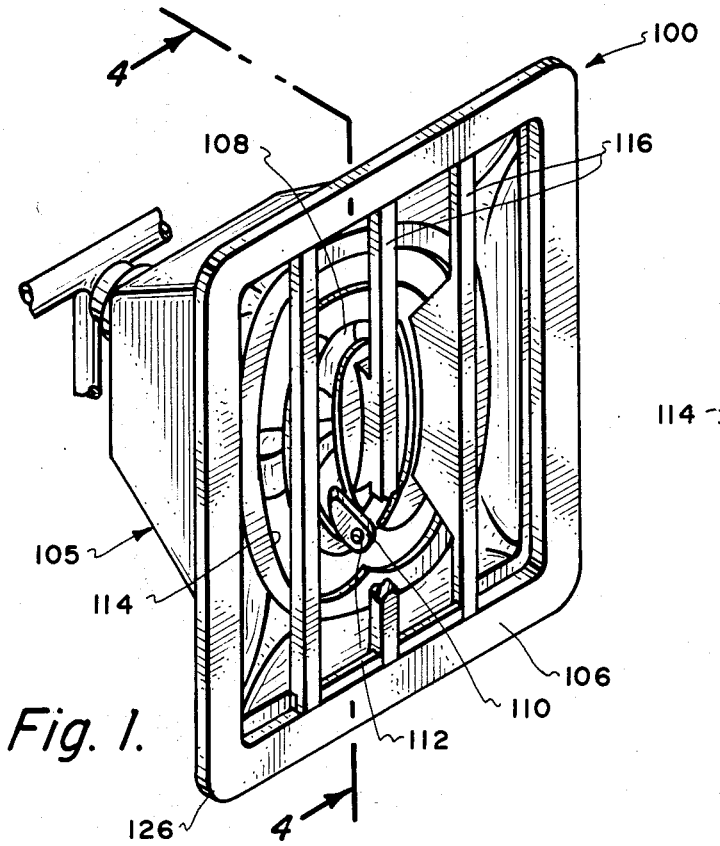
FIG. 1 is an isometric view of a hydrotherapy apparatus, as depicted in parent application Ser. No. 796,987 and in accordance with a first embodiment of the present invention.

Attention is initially directed to FIGS. 1-5 which illustrate a hydrotherapy apparatus 100 corresponding to the embodiment disclosed in FIGS. 18-24 of applicants' parent application Ser. No. 796,987. The apparatus 100 is intended to be mounted behind the inner peripheral wall 101 of a water tub 102 such as a spa, hot tub or bath tub for massaging the body of a user 104. The apparatus 100 is essentially comprised of a box-like housing 105 having a front wall 106 defining a guide slot 108. A movable slide member 110 defining a discharge orifice 112 is mounted in the guide slot 108 for movement along a travel path 114, depicted by dashed lines in FIG. 2. Spaced vertically oriented bars 116 are provided in front of the slide member 110 and guide slot 108 for supporting the back of the user 104.

Figure 3:
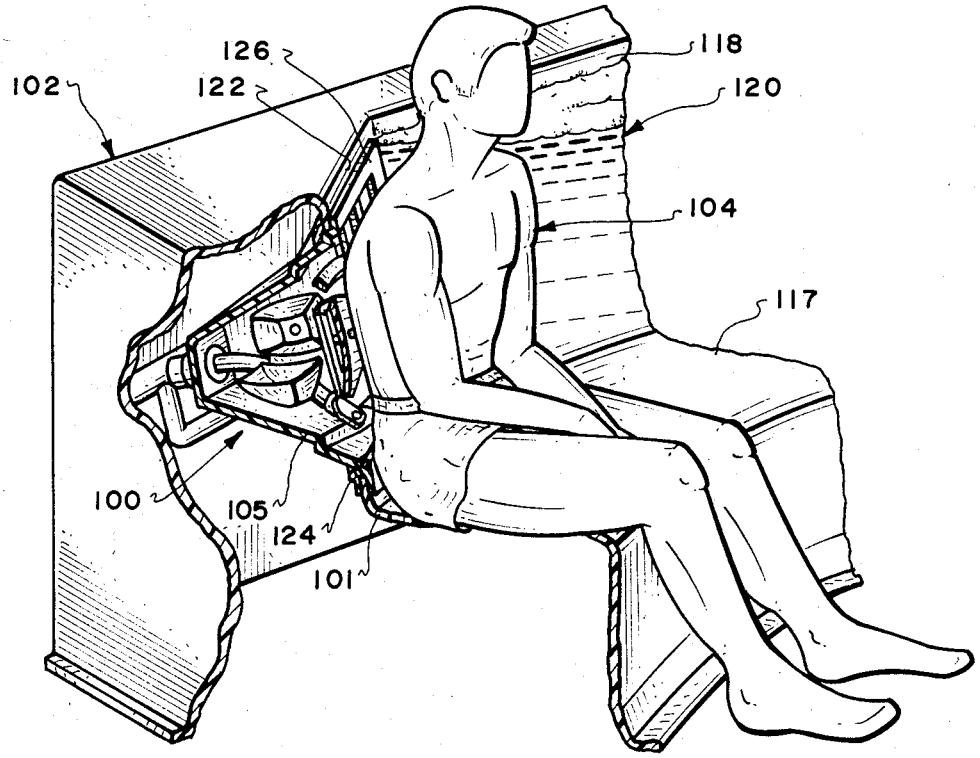
FIG. 3 is an isometric view, partially broken away, depicting the apparatus of FIG. 1 mounted behind the perimeter wall of a water tub, e.g. a spa.

FIG. 3 depicts the apparatus 100 in use in a typical spa installation wherein the water tub 102 is shaped to define for example, a bench 117 upon which the user 104 can comfortably sit with the major portion of his body below the upper surface 118 of a water pool 120. The tub inner peripheral wall 101 preferably includes a flat portion 122 through which a wall opening 124 is formed. The apparatus 100 is intended to be mounted in the opening 124 with the housing 105 projecting rearwardly and with the housing front wall frame 126 bearing against the front face of the flat wall portion 122.

Figure 2:
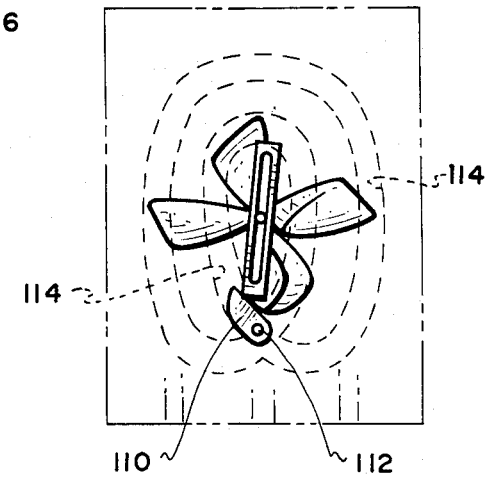
FIG. 2 is a front schematic illustration depicting the conduit subassembly of FIG. 1 and the travel path of the subassembly discharge orifice.

The general function of the apparatus 100 is to discharge a water stream beneath the surface of the water pool 120 for impacting against the body of the user 104 while concurrently translating the stream along a travel path 114 describing an area. As was discussed in applicants' parent application, the travel path 114 defined by the guide slot 108 can be of substantially any shape, including complex (i.e. nonlinear, noncircular) shapes comprised of essentially linear and arcuate portions arranged end to end. FIG. 2 depicts a preferred travel path configuration comprised of multiple path portions connected in series to form a closed loop along which the slide member translates. In typical embodiments of the invention, the travel path describes a substantially planar two dimensional area having a vertical dimension between six and twenty inches and a horizontal dimension between five and fourteen inches. Although these dimensions may vary considerably in different embodiments, it is preferable if the ratio of the vertical to horizontal dimension of the area is less than 4:1.

Figures 4, 5, 6:
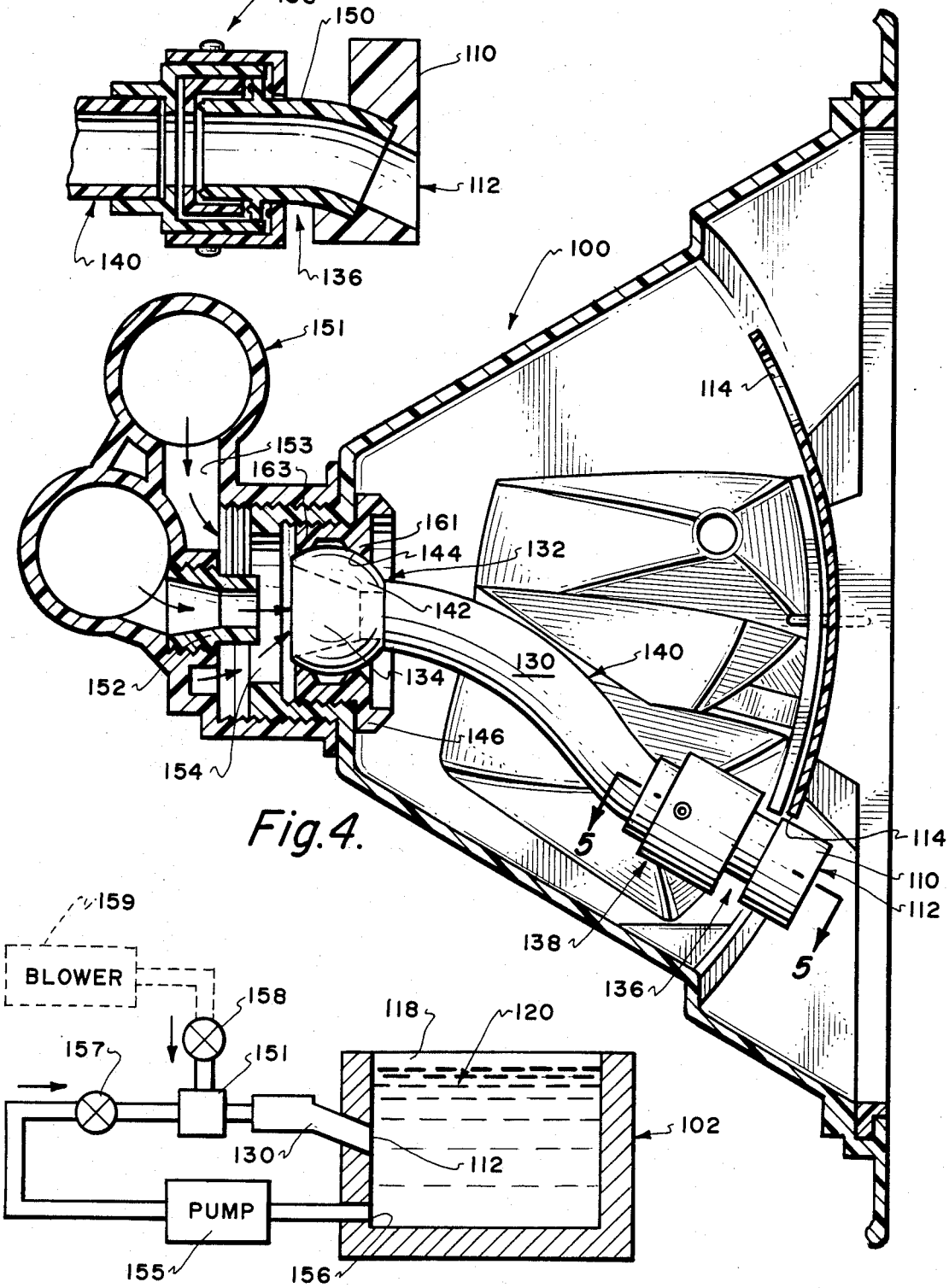
FIG. 4 is a sectional view taken substantially along the plane 4—4 of FIG. 1 depicting an embodiment substantially as shown in said parent application.
FIG. 5 is a sectional view taken substantially along the plane 5—5 of FIG. 4.
FIG. 6 is a schematic illustration depicting the manner in which an apparatus in accordance with the invention is plumbed in a typical installation.

FIGS. 4 and 5 show the internal construction of the apparatus 100 of FIGS. 1-3. Briefly, the apparatus is comprised of an elongated rigid conduit 130 having a tubular supply section 132 defining a supply orifice 134, a tubular discharge section 136 (including rotary coupling 138 and slide member 110) and a tubular intermediate section 140 coupling said supply section to said discharge section. The supply section 132 outer wall is shaped to define a ball 142 which is accommodated for rotation within a socket 144 defined in a fitting 146. The ball 142 has a tapered central bore which defines said aforementioned supply orifice 134.

The discharge section 136 includes rotary coupling 138 (FIG. 5) which couples the intermediate conduit section 140 to a short tubular member 150. The slide member 110 is fixedly mounted on the member 150.

The conduit 130 is mounted as shown in FIG. 4 with the ball positioned just forward of a water-air jet assembly 151. The jet assembly includes a nozzle 152 for discharging a water supply jet along a defined axis through a mixing cavity or chamber 154 into the conduit supply orifice 134. The water supply jet discharging into the cavity 134 creates a suction which typically functions to draw in air via air inlet 153 for mixing with the water supply jet. This capability for mixing water and air is typically incorporated in most hydrotherapy units because of the general perception that a more pleasing massaging effect is achieved by introducing air bubbles into the water stream.

As is discussed in applicants' parent application, the combined water-air stream from the jet assembly is discharged into the conduit 130 substantially along the axis of the conduit supply section 132. The stream then flows through the conduit and is discharged through the conduit discharge orifice 112 for impacting against the user 104. The conduit discharge section 136 discharges the stream from the discharge orifice 112 in a direction (FIG. 5) having a primary massage component extending substantially perpendicular to the tub wall and a secondary thrust component extending laterally to the supply section axis, or in other words, substantially parallel to travel path 114. This secondary thrust component produces a force on the discharge section 136 which thrusts it along the travel path 114 while rotating the ball 142 in the socket 144. The ball and socket surfaces essentially define a universal joint enabling the ball to rotate about a horizontally oriented axis (i.e. along the axis of the jet supply nozzle 152 and supply section axis) and a vertical axis therethrough. As a consequence of the rotational degrees of freedom between the ball 142 and the mating surfaces of socket 144, the slide member 110 is able to traverse the complex travel path 114.

FIG. 6 schematically depicts a typical plumbing installation for embodiments of the present invention and includes an electric motor driven pump 155 which pulls water from tub 102 via port 156. The pump 155 then supplies a water stream through a manually variable valve 157 to the jet assembly 151. Air is supplied to the jet assembly 151 via manually variable valve 158. The inlet side of valve 158 can simply be open to the air or can be coupled to the outlet of a motor driven blower 159.

The aforedescribed structure and operation of FIGS. 1–5 is disclosed in considerably more detail in applicants' parent application. Although the apparatus works quite well as described therein, in use it was observed that when the air supply to the mixing chamber 154 is cut off, either intentionally or inadvertently, the movement of the slide 110 along the travel path 114 becomes sluggish. It has now been recognized that this sluggishness occurs as a consequence of increased friction attributable to the suction, created by the water jet, acting on the conduit 130.

More specifically, and with continuing reference to FIG. 4, note that the socket 144 accommodating ball 142 is provided with a front annular bearing surface 161. In normal usage with sufficient air supplied into the cavity 154, the water jet from nozzle 152 acts to thrust the ball 142 forwardly against the annular bearing surface 161. The ball surface material and the annular bearing surface material are selected so as to produce relatively little friction loss. It has been observed, however, that when the air supply into the mixing chamber 154 is cut off, the suction created by the water jet discharging into the chamber 154 acts on the conduit 130 which forcefully draws the ball 142 rearwardly against the annular bearing surface 163. As a consequence, early embodiments of the invention as depicted in FIG. 4 have experienced some sluggishness of movement in the absence of sufficient air flow into cavity 154.

Figures 7, 8, 9:
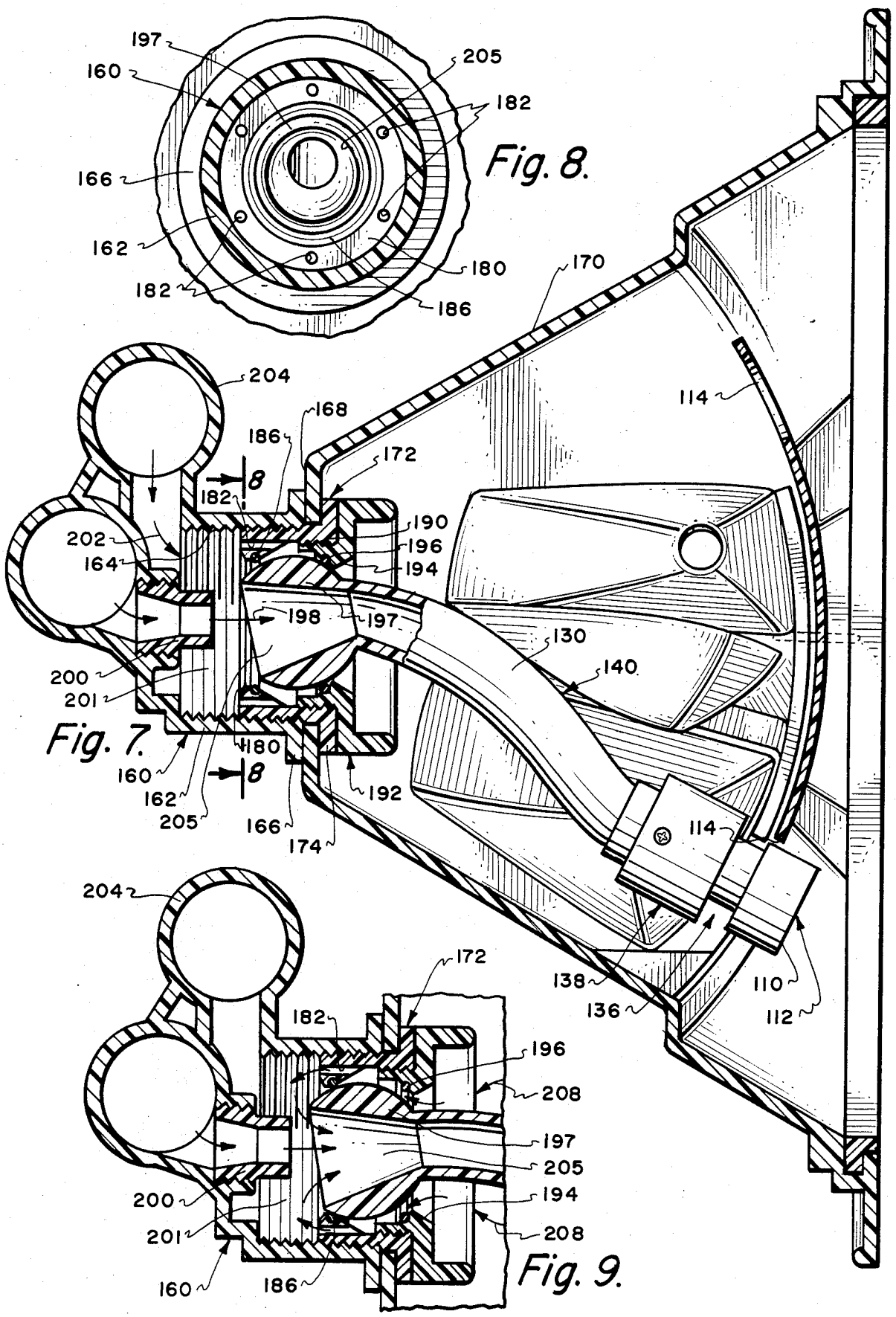
FIG. 7 is a sectional view depicting a first embodiment of the present invention, similar to the embodiment of FIG. 4, but differing therefrom to allow axial movement of the conduit.
FIG. 8 is a sectional view taken substantially along the plane 8—8 of FIG. 7.
FIG. 9 is a partial sectional view showing the conduit of FIG. 7 drawn to its rearward axial position.

Based on the foregoing, an improved embodiment of the invention has been designed and is depicted in FIGS. 7–9. Briefly, the embodiment of FIGS. 7–9 has been modified to mitigate the effects of friction increase attributable to air flow cut off by permitting the suction to draw tub water into the mixing cavity thereby breaking the suction effect on the conduit itself.

Referring now to FIGS. 7–9, note that the jet assembly 160 includes a forwardly projecting cylindrical section 162, internally threaded at 164. The section 162 defines a radially outwardly extending flange 166 which bears against the rear face of wall 168 of housing 170. A fitting 172 is threadedly engaged with section 162 and has a flange 174 which bears against the front face of housing wall 168. Fitting 172 defines an inner bore including a radially inwardly projecting ridge 180 which has axial passageways 182 extending therethrough. An annular bearing surface, such as O-ring 186, is formed on the forward side of ridge 180.

The forward end of the inner bore of fitting 172 is internally threaded at 190 for accommodating an externally threaded portion of fitting 192. Fitting 192 defines a central bore and a radially inwardly projecting ridge 194. An annular bearing surface, such as an O-ring 196, is formed on the rear side of ridge 194.

With the fittings 172 and 192 threaded to each other and to the jet assembly 160 and housing 170 as depicted in FIG. 7, it will be noted that the conduit ball 197 is accommodated between the front annular bearing surface 196 and the rear annular bearing surface 186. These annular bearing surfaces 186, 196 are spaced sufficiently to permit limited axial movement of the conduit ball 197.

In normal use, the water jet 198 supplied from jet assembly nozzle 200 will produce a suction within the mixing cavity 201 defined by the bore of jet assembly section 162. This will draw air 202 from air supply pipe 204. The water jet with the air entrained therein will be discharged into the conduit supply orifice 205 thrusting the ball 197 forwardly against the annular bearing surface 196. With the conduit ball sealed against the bearing surface 196, the passageway openings 182 serve no function. However, now assume that the available air 202 is cut off or substantially reduced. As a consequence, the suction created by the water jet 198 will act on the conduit drawing it to its rearward position as depicted in FIG. 9. As a consequence, clearance is then created between the ball surface and the forward annular bearing surface 196. This permits tub water 208 to be drawn between the ball surface and the bearing surface 196 through the passageway openings 182 into the mixing cavity 201. As a consequence, the force drawing the ball against the rear annular bearing surface 186 will be mitigated as compared to the embodiment of FIG. 4, and the aforementioned sluggish movement of the conduit will be avoided.

Figure 10:
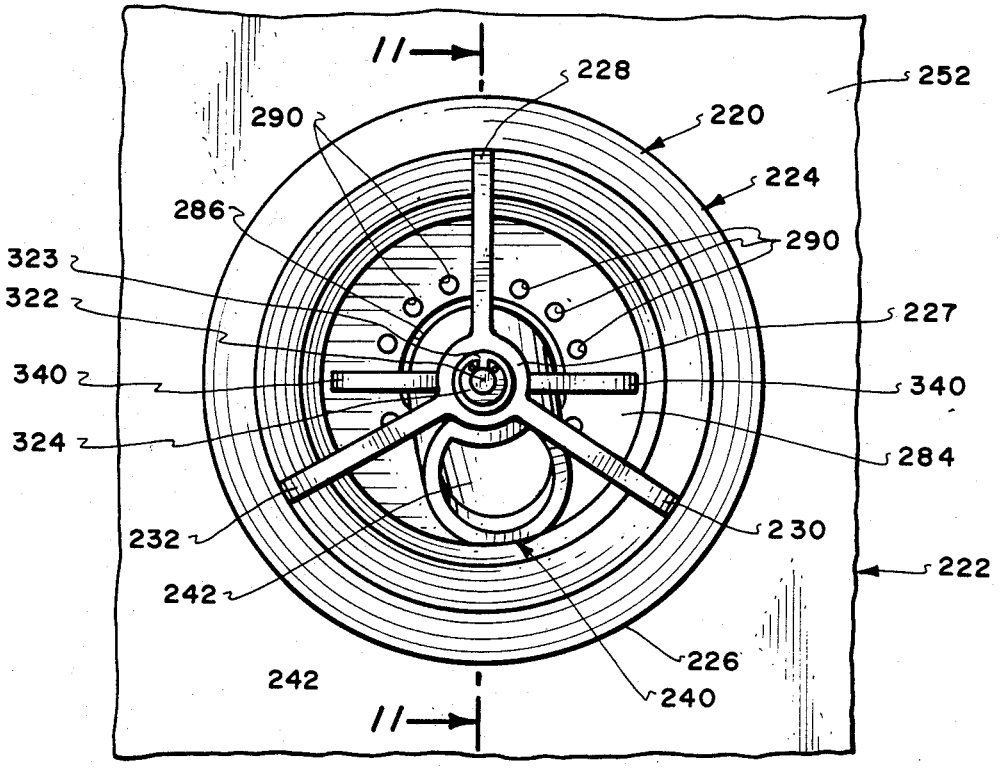
FIG. 10 is a front view of a second embodiment of the present invention.
Figure 12:
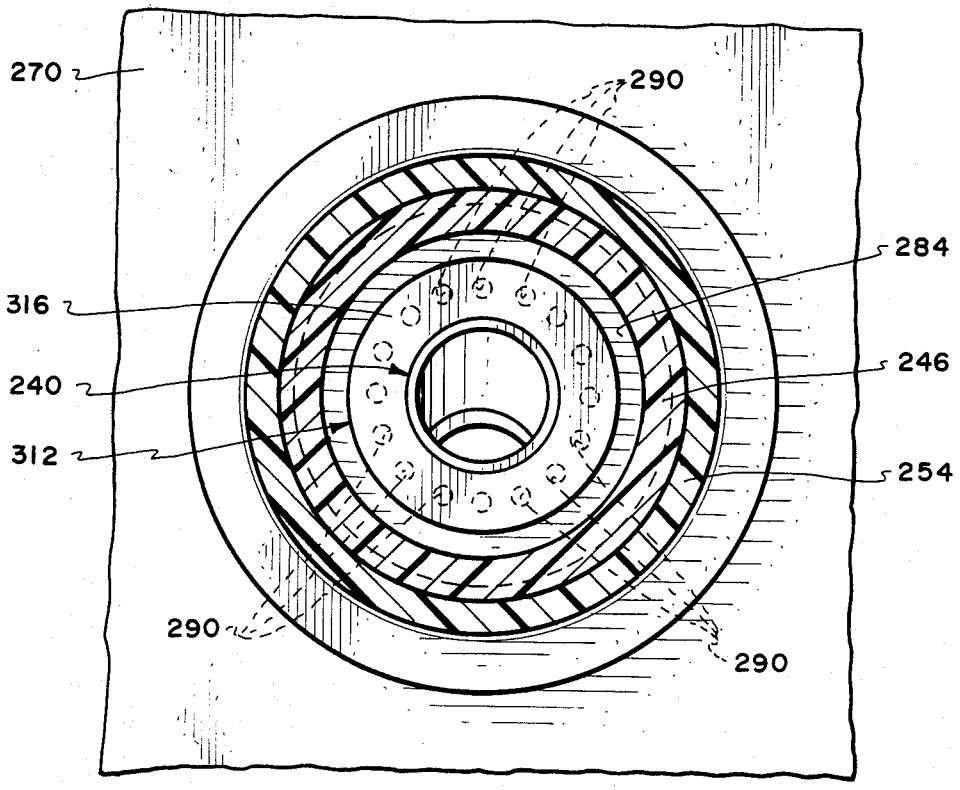
FIG. 12 is a sectional view taken substantially along the plane 12—12 of FIG. 11.

Attention is now directed to FIGS. 10–13 which illustrate a second embodiment of the invention particularly intended for installations in water tubs where only a shallow depth is available behind the water tub inner peripheral wall and/or where it may not be practical to provide a large flat tub wall portion 122 as shown in FIG. 3. FIG. 10 shows a front view of a hydrotherapy apparatus 220 mounted in an opening in the inner peripheral wall 222 of a water tub, as would be seen by a user sitting in the tub. The apparatus 220 includes an external grill member 224 comprised of an outer flange ring 226, an inner central ring 227, and radial arms 228, 230, and 232 extending from ring 227 to ring 226. A conduit 240 is mounted behind the grill member 224 so as to enable its discharge orifice 242 to move along a circular path as will be described in greater detail hereinafter.

Figure 11:
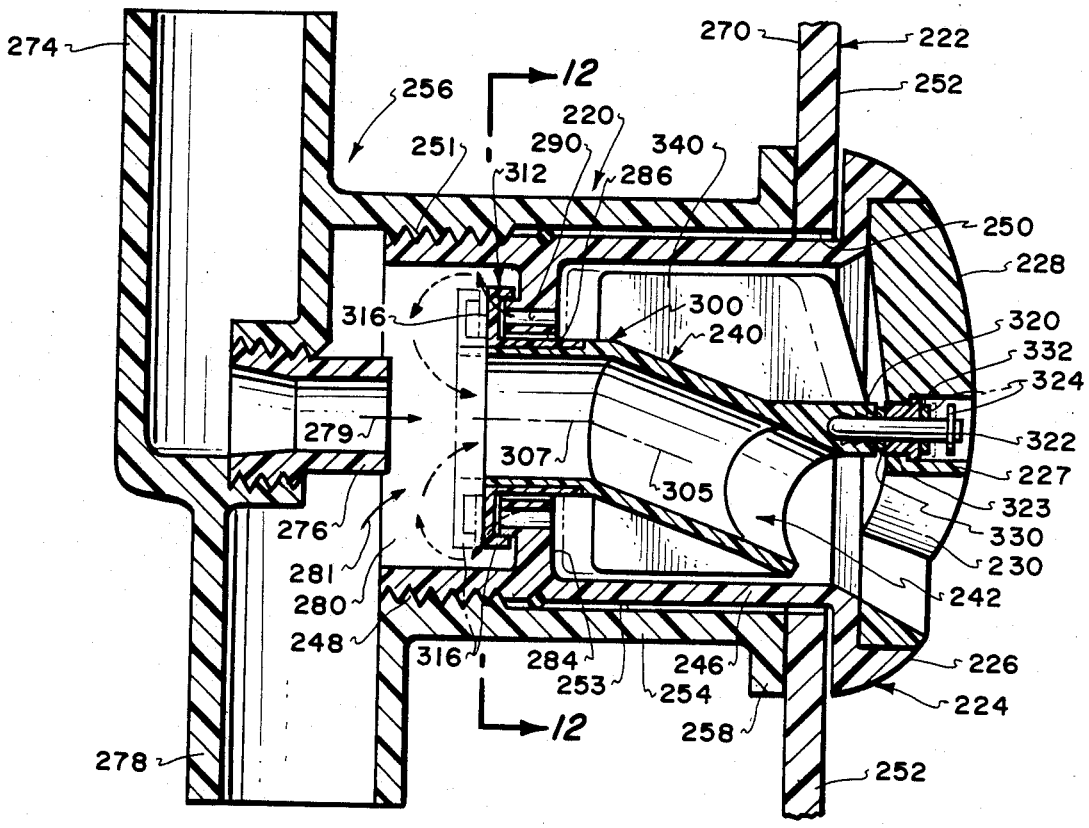
FIG. 11 is a sectional view taken substantially along the plane 11—11 of FIG. 10.
Figure 13:
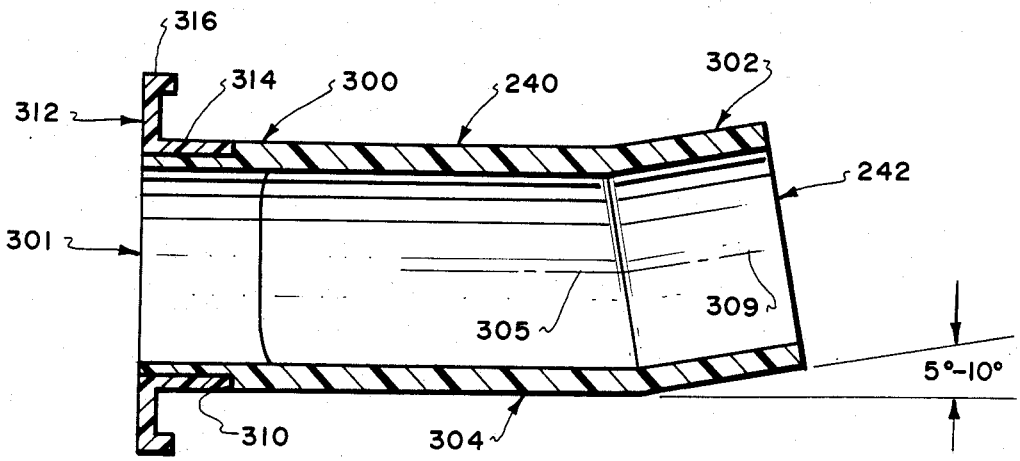
FIG. 13 is a sectional view of the conduit depicted in FIG. 11 but rotated by approximately 90° around the supply axis.

With continuing reference to FIG. 11, note that the grill member 224 includes a cylindrical section 246 projecting rearwardly through opening 250 in tub wall 222. The flange ring 226 bears rearwardly against the front face 252 of the tub wall 222. Although the apparatus 220 can theoretically be of any size, it is intended primarily for applications where the wall opening 250 is of relatively small dimension, e.g. between two and six inches in diameter. The rearwardly extending section 246 is externally threaded at 248 and is engaged with internal threads 251 formed within central bore 253 of pipe section 254 of jet assembly 256. Section 254 is provided with a radially extending flange 258 which bears against the rear face 270 of wall 222.

The jet assembly 256 additionally includes a water inlet 274 for supplying water to jet nozzle 276 and an air inlet 278. The water jet 279 discharged from nozzle 276 into cavity 280 normally draws air 281 into the cavity from inlet 278. A radially extending wall 284 is formed within the bore of section 246. The wall 284 has a large central opening 286 defining a bushing or bearing surface. Multiple passageway openings 290 extend axially through the wall 284 around the central opening 286.

The aforementioned conduit 240 comprises an integral, i.e. one piece, elongated rigid tube which is formed to essentially define a cylindrical supply section 300, a cylindrical discharge section 302, and a cylindrical intermediate section 304. The conduit is open at both ends having a supply orifice 301 at its supply section end and the aforementioned discharge orifice 242 at its discharge section end. The supply and intermediate sections are oriented so that the axis (depicted by dashed line 305) of the intermediate section 304 deviates by an acute angle (FIG. 11) from the axis (depicted by dashed line 307) of the supply section 300. The axes of the supply and intermediate sections 300, 304 define a plane and the axis (depicted by dashed line 309) of the discharge section 302 deviates by an acute angle (FIG. 13) from that plane. The outer wall surface of the conduit supply section 300 is recessed at 310 and a bearing member 312 is fixed therein. The bearing member 312 includes a cylindrical section 314 and a flange section 316. The bearing member cylindrical section 314 is accommodated within the central opening 286 bearing surface for rotation around the axis of supply section 300.

The conduit 240 includes a forwardly projecting boss 320 which has a pin 322 staked therein along the axis of the jet assembly nozzle 276 and supply section axis 307. The pin 322 extends through a small bushing 323 mounted in the central ring 227 of the grill member 224. The pin 322 is dimensioned so that it can both rotate in, and move axially in, the bushing 323. Similarly, the bearing member 312 is dimensioned so that it can both rotate in, and move axially in the central wall opening 286. As a consequence, the conduit is able to move between the forward solid line position depicted in FIG. 11 and a rearward dashed line position. Note that when the conduit is in the forward position, the passageway openings 290 will be sealed by the bearing member flange 316. When the conduit 240 is moved to the rear position, the flange 316 is displaced from the passageway openings 290 to permit tub water to be drawn rearwardly into the mixing cavity 280.

In the normal operation of the embodiment of FIGS. 10–13, nozzle 276 will discharge a water jet into the conduit supply section 300 through the mixing cavity 280. The discharged water jet will produce a suction which will draw air into cavity 280 via air inlet 278 and the mixed water air stream will then traverse the length of the conduit and be discharged through the discharge orifice 242. Inasmuch as the stream will be discharged in a direction having a component extending laterally to the rotational axis defined by pin 322 and supply section axis 307, and because it is displaced from the rotational axis, the component will act to rotate the conduit around the rotational axis i.e., around pin 322. With sufficient air supplied via air inlet 278, the conduit will be in its forward axial position and the axial thrust produced by water supply jet 279 will be borne primarily by washer 330. Since washer 330 contacts bushing 323 over a small diameter it will produce relatively low frictional loading. If the air supply from inlet 278 is reduced or cut off, the suction produced by the water jet will pull the conduit 240 rearwardly to its dashed line position (FIG. 11) thereby opening passageway openings 290 enabling tub water to be drawn rearwardly therethrough for entrainment with the supplied water jet. In the rearward position, the rearward axial thrust is borne primarily by washer 332 acting between bushing 323 and a retaining clip 324 mounted in a slot near the free end of pin 322. This engagement will likewise produce very low frictional loading because of the minimal contact area over a small diameter.

As might be expected, a slightly different massaging sensation is produced depending upon whether the supplied water jet entrains air or tub water. By providing an air control valve (as 158 in FIG. 6) a user can control the amount of air and amount of tub water entrained in the discharge stream without significantly varying the speed at which the discharge orifice 242 moves along its circular travel path.

In order to prevent the conduit 240 from rotating too fast, speed dependent drag elements in the form of wings or plates 340 extend radially from conduit 240. On starting from rest, the plates 340 provide relatively little resistance to rotation of the conduit. However, as rotational speed increases, the plates 340 encounter increasing resistance as they move through the water and thereby essentially act as a governor to limit the speed of rotation.

Figure 14:
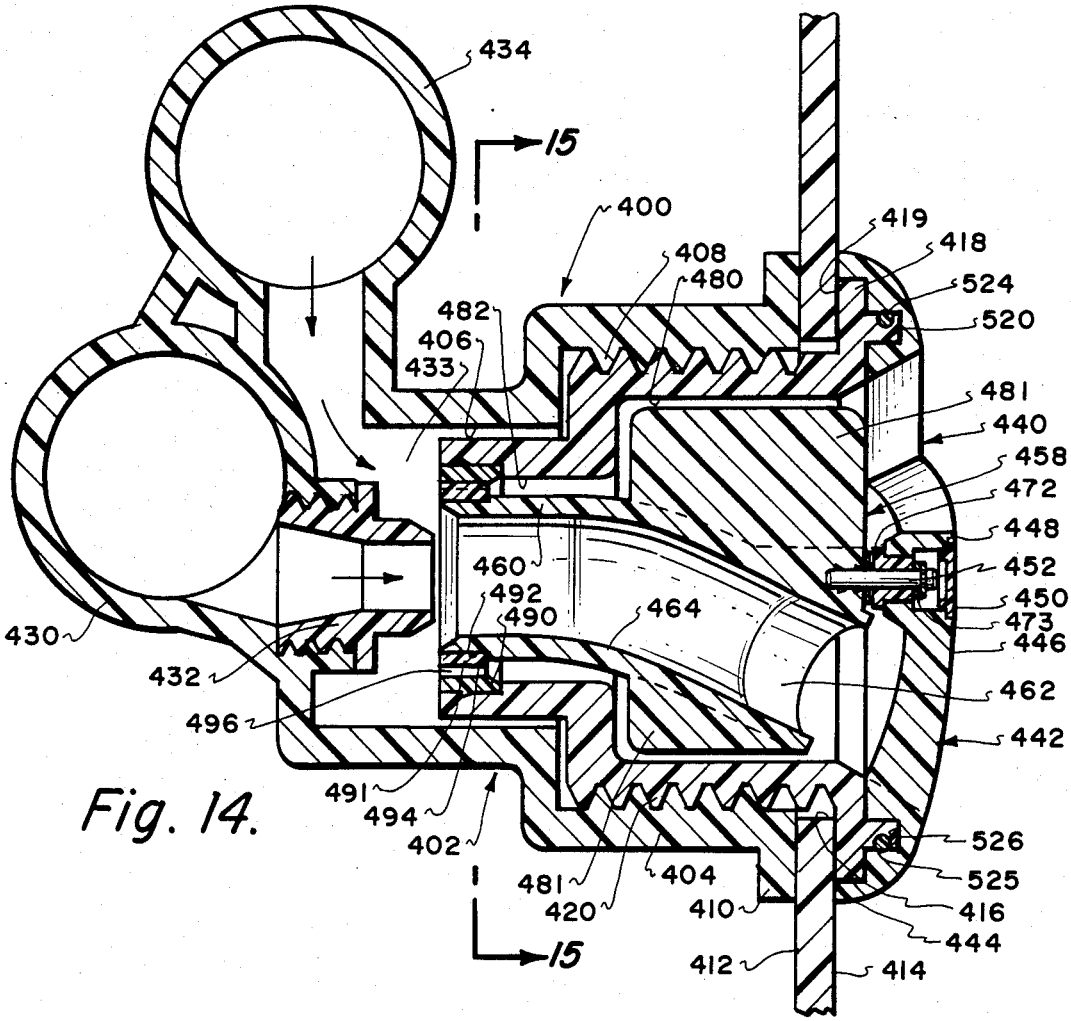
FIG. 14 is a sectional view similar to FIG. 11 but depicting a third embodiment of the present invention.
Figure 15:
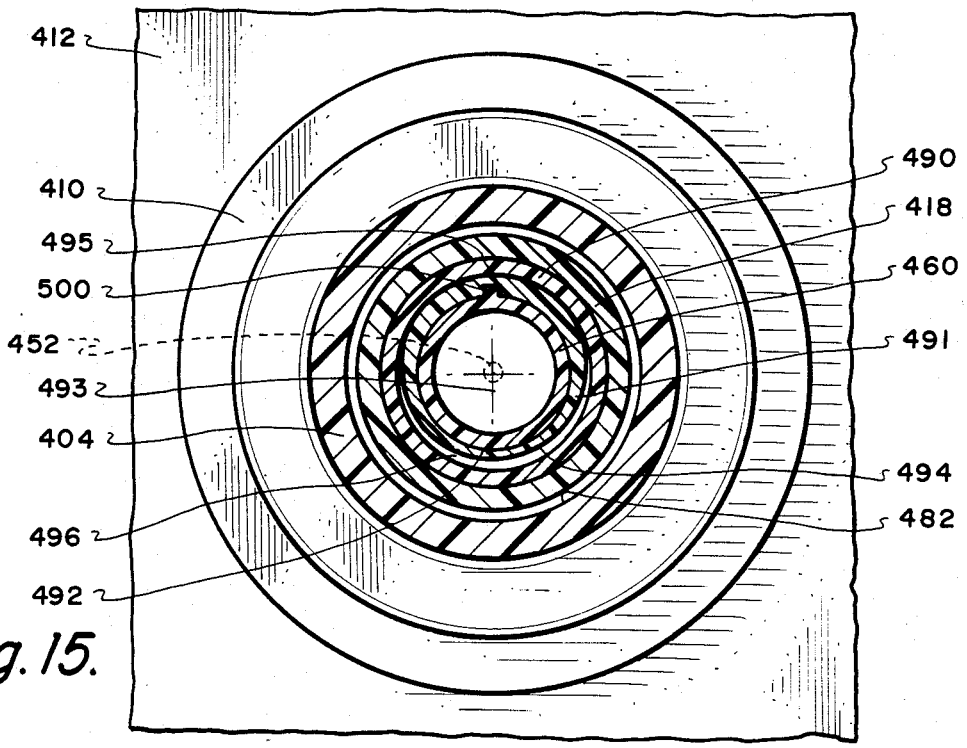
FIG. 15 is a sectional view taken substantially along the plane 15—15 of FIG. 14.
Figure 16:
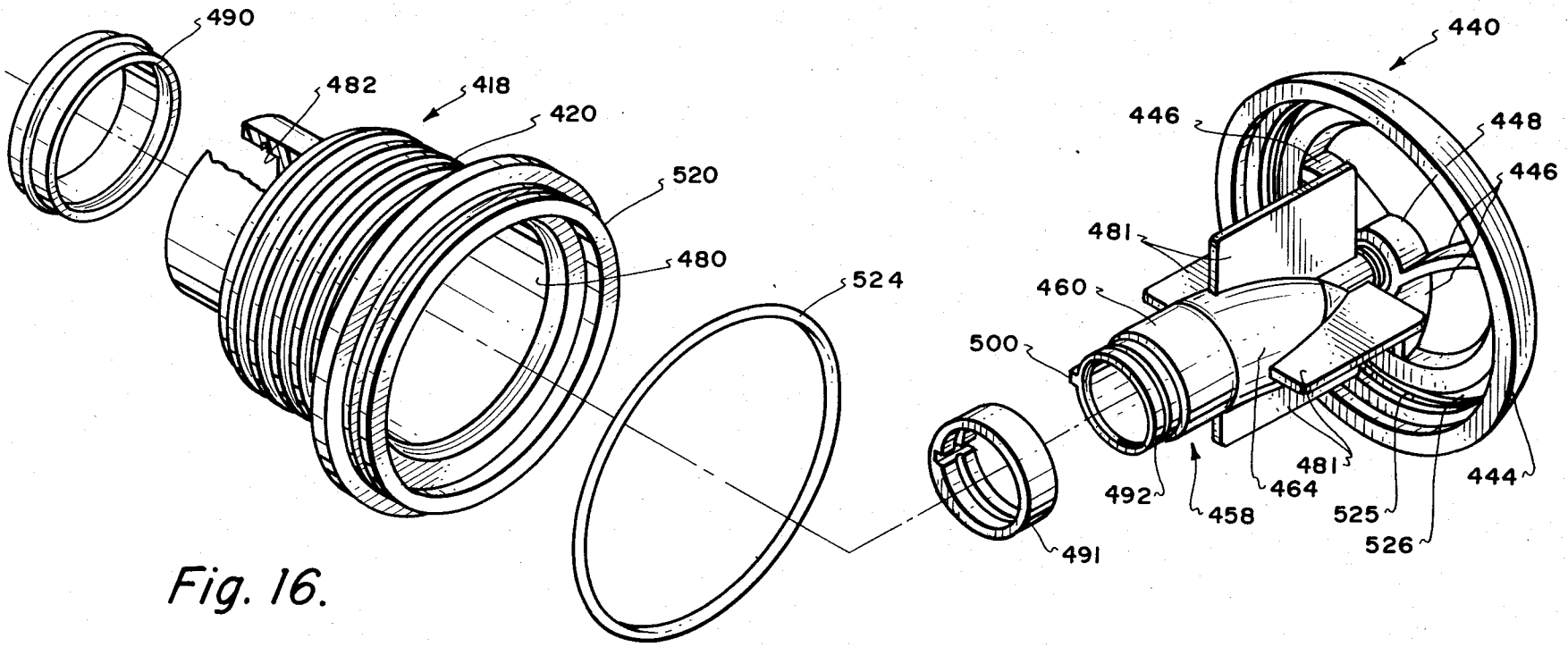
FIG. 16 is an exploded isometric illustration generally depicting how the conduit subassembly can be readily removed for replacement and cleaning.

Attention is now directed to FIGS. 14–16 which illustrate a still further embodiment 400 of the present invention. The embodiment of FIGS. 14–16 is intended for the same type of applications and installations as the previously discussed embodiment of FIGS. 10–13. Indeed, the front view depicted in FIG. 10 is the same for both embodiments. However, the embodiment of FIGS. 14–16 is somewhat simpler in construction, operates with even lower friction losses, and can be more readily cleaned and serviced.

The apparatus 400 includes a jet assembly 402 including a forwardly projecting substantially cylindrical section 404 having a central bore 406 internally threaded at 408. The section 404 is provided with a radially extending flange 410 which bears against the rear face 412 of tub wall 414 around wall opening 416. The section 404 is retained against wall face 412 in alignment with wall opening 416 by fitting 418 which includes an externally threaded rearwardly extending section 420 engaged with the internally threaded wall of bore 406. Fitting 418 is provided with radially extending flange 419 which bears against the front face of tub wall 414. The jet assembly 402 further includes a water inlet 430 for discharging a water jet through nozzle 432 into cavity 433 and an air inlet 434 for supplying air to the cavity.

A conduit/grill subassembly 440 is provided and includes a front grill plate 442 comprised of an outer ring 444 and radially extending arms 446 which are joined to a central ring 448. A bushing 450 is mounted in the ring 448, and accommodates pin 452 for rotation therein. The pin 452 is staked into the forward end of conduit 458. FIG. 14 depicts the integral conduit 458 slightly differently than in FIGS. 11 and 13 primarily in that the conduit supply, intermediate, and discharge sections are shown blending into one another with smooth curves rather than the more severe angles shown in FIGS. 11 and 13. Smooth curves afford smoother fluid flow and lower energy loss and are therefore preferable. In any event, the conduit 458 still includes a supply section 460, a discharge section 462, and intermediate section 464. The pin 452 is aligned with the axis of the supply section 460 and, when assembled, with the axis of jet nozzle 432. The axis of intermediate section 464 deviates by an acute angle from the axis of supply section 460. The axis of discharge section 462 deviates by an acute angle from the plane defined by the axes of the supply and intermediate sections. Thus, a water stream will exit from the discharge orifice of the discharge section 462 in a direction which includes a component extending normal to said plane and displaced from the axis of the supply section 460 thereby tending to rotate the conduit around the pin 452. The pin 452 acts to accommodate both axial and lateral thrust acting on the conduit. That is, in contrast to the embodiment of FIG. 11 in which the conduit was mounted for limited axial movement between forward and rearward positions, the conduit of FIG. 14 is fixedly axially mounted relative to the front grill plate 442. Forward thrust developed against the conduit by the water jet from nozzle 432 is thereby accommodated by the bearing washer 472. Rearward thrust produced by suction is accommodated by the bearing washer 473 acting between bushing 450 and a retaining clip carried by pin 452.

The wall fitting 418 defines a central bore including a forward portion 480, enlarged to accommodate the conduit drag plates 481, and a reduced rear portion 482. The conduit supply section 460 is received for rotation within the reduced portion 482 or more specifically, within a cylindrical bushing 490 mounted within portion 482. The supply section 460 preferably has a specially configured bearing 491 mounted thereon for cooperating with the inner bearing surface of bushing 490 in order to minimize friction loss therebetween.

More specifically, whereas the inner bearing surface of bushing 490 is cylindrical, the outer surface of bearing 491 is configured eccentrically with respect thereto so that they contact along a very narrow band (i.e. ideally, line contact). With reference to FIG. 15, note that bearing 491 has an inner circumferential wall surface 492 defined by a circle whose center lies on the axis of rotation 493 defined by pin 452. The outer circumferential wall surface 494 of bearing 491 is also defined by a circle but whose center is slightly displaced from the center 493 of circle 492. As a result, the outer wall surface 494 effectively has a high point, as at 495, along which it contacts the inner bearing surface of bushing 490, as the bearing 491 rotates around axis 493. The outer wall surface 494 is dimensioned so as to provide a significant gap 496 (e.g. so that the gap at its widest point is in excess of 0.015 inches) between wall 494 and the inner surface of bushing 490. The gap 496 permits tub water to be drawn rearwardly into mixing cavity 433, functioning as a water lubricated bearing, but also further reducing friction loss by creating, via venturi action, a reduced pressure in the gap thus mitigating the intensity of the engagement between the high point 495 of the bearing wall surface 494 and the bushing inner surface. It should be noted that the orientation of the bearing 491 is keyed to the conduit at 500 to assure that the high point 495 of the outer wall surface 494 is located opposite to the effective direction of the thrust produced by the water stream discharged from the conduit discharge orifice. More specifically, the stream discharged from the discharge orifice will produce a lateral force on the conduit which, acting at a distance from the rotational axis defined by pin 452, will produce a torque for rotating the conduit about the rotational axis. However, this lateral force will also produce a lateral thrust on the conduit which will be absorbed partially by the pin 452 but which will also act on the conduit bearing 491 engaging against the bushing 490 inner surface.

The conduit/grill subassembly 440 is removably mounted to the fitting 418 by a snap fit so it can be readily removed from the fitting 418 for cleaning and for access to the jet nozzle 432. The fitting 418 includes a forwardly projecting lip 520 which accommodates a flexible O-ring 524 extending circumferentially therearound. The ring 444 of the conduit/grill subassembly 440 includes a circular recess 526 for accommodating the lip 520 of the fitting 418. The O-ring 524 extends slightly out of its recess in the lip 520 to engage a shallow annular depression 525 in the surface of the recess 526 in the ring 444. When it is desired to remove the subassembly 440, it is withdrawn by manually pulling axially on the grill plate. In this manner, access is provided to the interior of fitting 418 for cleaning, which is indeed desirable in a bath tube type installation. Moreover, this manner of mounting the conduit/grill subassembly makes it readily available for servicing should such be necessary.

Although embodiments of the invention, of course, can be constructed in various sizes, an exemplary apparatus constructed in accordance with FIGS. 14–16, and intended to fit within a 2½ inch circular wall opening 416, has the following dimensions:

1. conduit overall length (without pin): approx. 2.5 inches
2. conduit inner diameter: approx. 0.67 inches
3. supply nozzle inner diameter: approx. 0.37 inches
4. supply/intermediate section angle: approx. 30°
5. discharge section/plane angle: approx. 10°
6. front grill outer diameter: approx. 3.5 inches The apparatus can be constructed entirely of molded plastic parts but it is preferable for the pin 452 and associated washers to be of metal to minimize friction and wear.

From the foregoing, it should now be apparent that an improved method and apparatus for hydrotherapy has been disclosed herein characterized by discharging a water stream through a rigid conduit while concurrently translating the conduit discharge orifice along a nonlinear path. The conduit is generally comprised of a supply section and a discharge section having an axis misaligned with the supply section axis for discharging a stream in a direction tending to rotate the conduit around the supply section axis. In two of the disclosed embodiments, the conduit is mounted so that it can rotate around only one axis whereby the conduit discharge orifice is constrained to move long a circular travel path. In another embodiment, a ball and socket mounting permits motion of the conduit discharge orifice along a complex, i.e. nonlinear, noncircular travel path. In accordance with a preferred aspect of the invention, frictional loading of the conduit attributable to suction is mitigated by providing a passageway which permits the suction to draw tub water into a cavity where it is entrained by a water supply jet for discharge through the conduit. In accordance with another preferred aspect, a pin mounted for rotation is secured to the conduit and extends therefrom in alignment with the supply jet, for providing support against axial and lateral thrust.

Although particular embodiments of the invention have been described and illustrated in detail, it is recognized that various modifications and alternatives may readily occur to those skilled in the art and it is intended that the claims be interpreted to cover such modifications, alternatives, and other equivalents.

We claim:

1. Hydrotherapy apparatus for discharging a fluid stream useful for impacting against and massaging an area of a user's body, said apparatus comprising:

supply means including a cavity and means for discharging a water jet along a defined axis into said cavity for creating a suction therein;

an elongated rigid conduit including a tubular supply section having a supply orifice and a tubular discharge section having a discharge orifice, said discharge section defining an axis misaligned with the axis of said supply section;

means mounting said conduit with said supply orifice opening to said cavity and with said supply section axis substantially aligned with the axis of said water jet whereby water supplied from said jet will flow through said conduit to said discharge orifice;

said mounting means including means supporting said conduit supply section for rotation about said supply section axis whereby said discharge orifice will translate along a nonlinear path describing a substantially planar area; and passageway means for drawing water from outside said conduit into said cavity to mitigate the effect of said suction on said conduit.

2. The apparatus of claim 1 wherein said supply means further includes means for supplying air to said cavity.

3. The apparatus of claim 1 wherein said conduit further includes a tubular intermediate section coupling said supply section to said discharge section; and wherein said intermediate section axis deviates by an acute angle from said supply section axis.

4. The apparatus of claim 3 wherein the axis of said conduit discharge section deviates by an acute angle from the plane defined by the axes of said supply and intermediate section whereby water is discharged from said discharge orifice in a direction including a component producing a force on said discharge section for rotating said conduit around said supply section axis.

5. The apparatus of claim 1 in combination with a water tub having a peripheral wall;

means mounting said apparatus in a first opening in said peripheral wall with said conduit oriented so that water discharged through said discharge orifice flows into said tub.

6. The apparatus of claim 5 including a second opening in said peripheral wall;

pump means having a suction side and a pressure side; and means coupling said pump means suction side to said second opening and said pressure side to said means for discharging said water jet into said cavity.

7. The apparatus of claim 1, wherein said means supporting said conduit supply section for rotation about said supply section axis further permits said supply section to pivot vertically and/or horizontally relative to said water jet axis.

8. The apparatus of claim 1 wherein said conduit supply section includes a peripheral ball surface; and wherein said means supporting said conduit supply section includes socket means for accommodating said ball surface for permitting said supply section to rotate about, and pivot vertically and/or horizontally relative to, said water jet axis.

9. The apparatus of claim 8 including guide means defining said path; and means coupling said conduit discharge section to said guide means for translating said discharge orifice along said path.

10. The apparatus of claim 1 wherein said conduit is mounted for limited movement substantially along said conduit supply section axis between forward and rearward positions; and including means for sealing said passageway means when said conduit is in said forward position and opening said passageway means when said conduit is in said rearward position.

11. The apparatus of claim 8 wherein said conduit is mounted for limited movement substantially along said conduit supply section axis between forward and rearward positions.

12. The apparatus of claim 11 wherein said socket means includes spaced forward and rearward bearing surfaces; and wherein said ball surface bears against said forward bearing surface when said conduit is in said forward position and against said rearward bearing surface when said conduit is in said rearward position.

13. The apparatus of claim 1 including:

a bushing fixedly mounted along the axis of said water jet, said bushing having a bore extending axially therethrough; and wherein said conduit supply section is accommodated in said bushing bore for rotation therein about said supply section axis.

14. The apparatus of claim 13 including a pin supported substantially in alignment with said water jet axis proximate to said conduit discharge section; and means coupling said conduit to said pin for rotation thereabout for translating said discharge orifice along a circular path.

15. The apparatus of claim 13 wherein said conduit supply section is accommodated in said bushing for limited movement substantially along said supply section axis between forward and rearward positions; and including means for sealing said passageway means when said conduit is in said forward position and opening said passageway means when said conduit is in said rearward position.

16. The apparatus of claim 13 wherein said conduit supply section has an outer cross-sectional wall surface dimensioned sufficiently smaller than the inner cross-sectional dimension of said bore to pass water flow therebetween.

17. The apparatus of claim 16 wherein said conduit supply section outer circumferential wall surface is configured to contact the inner surface of said bushing bore only along a narrow band of said outer circumferential wall surface.

18. The apparatus of claim 17 wherein said conduit further includes a tubular intermediate section coupling said supply section to said discharge section; and wherein said intermediate section axis deviates by an acute angle from said supply section axis; and wherein the axis of said discharge section deviates by an acute angle from the plane defined by the axes of said supply section and intermediate section whereby water is discharged from said discharge orifice in a direction having a component producing a thrust on said discharge section for rotating said conduit around said supply section axis.

19. The apparatus of claim 18 wherein said narrow band is oriented on said supply section outer circumferential wall surface so that thrust produced by water discharged from said discharge orifice will urge said narrow band into contact with the inner surface of said bore; and wherein water flow between said outer circumferential wall surface and said bore inner surface will mitigate the force with which said narrow band is urged against said bore inner surface.

20. The apparatus of claim 13 including a substantially planar grill; and means securing said pin to said grill whereby said conduit, said pin, and said grill comprise an integrated subassembly.

21. The apparatus of claim 20 wherein said supply means further includes a housing defining said cavity;

means for supporting said bushing in said housing; and means for removably mounting said integrated subassembly in said housing with said conduit supply section extending into said bushing.

22. The apparatus of claim 21 in combination with a water tub having a peripheral wall including an opening;

means mounting said supply means housing behind said peripheral wall in alignment with said opening; and wherein said integrated subassembly is receivable through said opening for removable mounting in operative relationship with said supply means and said bushing.

23. Hydrotherapy apparatus for discharging a fluid stream useful for impacting against and massaging an area of a user's body, said apparatus comprising:

supply means for discharging a water jet along a defined axis;

an elongated rigid conduit including a tubular supply section having a supply orifice and a tubular discharge section having a discharge orifice, said discharge section defining an axis misaligned with the axis of said supply section;

means mounting said conduit with said supply orifice substantially aligned with the axis of said water jet whereby water from said jet will flow through said conduit to said discharge orifice;

said mounting means including means supporting said conduit supply section for rotation about said supply section axis;

a pin supported substantially in alignment with said water jet axis; and means coupling said conduit to said pin for rotation thereabout for translating said discharge orifice along a circular path and for supporting said conduit against lateral and axial thrust.

24. The apparatus of claim 23 wherein said conduit includes a tubular intermediate section coupling said supply section to said discharge section; and wherein said intermediate section axis deviates by an acute angle from said supply section axis.

25. The apparatus of claim 24 wherein the axis of said conduit discharge section deviates by an acute angle from the plane defined by the axes of said supply and intermediate sections whereby water is discharged from said discharge orifice in a direction including a thrust component for rotating said conduit around said supply section axis.

26. The apparatus of claim 23 in combination with a water tub having a peripheral wall;

means mounting said apparatus in a first opening in said peripheral wall with said conduit oriented so that water discharged through said discharge orifice flows into said tub.

27. The apparatus of claim 26 including a second opening in said peripheral wall;

pump means having a suction side and a pressure side; and means coupling said pump means suction side to said second opening and said pressure side to said supply means for discharging a water jet.

28. The apparatus of claim 23 including:

a bushing having a substantially cylindrical bore fixedly mounted along said water jet axis; and wherein said conduit supply section is accommodated in said bushing bore for rotation therein about said supply section axis.

29. The apparatus of claim 28 wherein said conduit further includes a tubular intermediate section coupling said supply section to said discharge section; and wherein said intermediate section axis deviates by an acute angle from said supply end axis; and wherein the axis of said discharge section deviates by an acute angle from the plane defined by the axes of said supply and intermediate section whereby water is discharged from said discharge orifice in a direction having a component producing a thrust on said discharge section for rotating said conduit around said supply section axis.

30. The apparatus of claim 23 including a substantially planar grill; and means securing said pin to said grill whereby said conduit, said pin, and said grill comprise an integrated subassembly.

31. The apparatus of claim 30 wherein said supply means further includes a housing defining a cavity oriented so that said water jet is discharged into said cavity to create a suction therein.

32. The apparatus of claim 31 in combination with a water tub having a peripheral wall including an opening;

means mounting said supply means housing behind said peripheral wall in alignment with said opening; and wherein said integrated subassembly is receivable through said opening for removable mounting in operative relationship with said supply means.

33. Hydrotherapy apparatus for use in a water tub for discharging a water stream beneath the surface of a water pool in said tub for impacting against and massaging an area of a user's body, said apparatus comprising:

means defining a suction cavity;

means for supplying a water supply stream to said cavity along a defined axis to create suction in said cavity;

an elongated conduit having a supply orifice at one end and a discharge orifice at a second end;

means mounting said conduit for rotation around the axis of said supply orifice with said supply orifice communicating with said cavity and located proximate to said means supplying said supply stream;

said conduit discharge orifice defining an axis misaligned with the axis of said supply orifice for discharging a water stream in a direction to rotate said conduit around said supply orifice axis and translating said discharge orifice along a path describing said area; and passageway means communicating with said cavity for drawing water from said water pool into said cavity.

34. The apparatus of claim 33 wherein said conduit includes an outer peripheral wall; and wherein said means mounting said conduit for rotation includes a bearing surface substantially surrounding said conduit outer peripheral wall; and wherein said bearing surface is dimensioned sufficiently larger than said outer peripheral wall for providing said passageway means therebetween.

35. The apparatus of claim 33 wherein said conduit is mounted for limited axial movement between a forward position and a rearward position; and wherein said passageway means is closed when said conduit is in said forward position and open when said conduit is in said rearward position.

36. The apparatus of claim 33 wherein said mounting means includes universal joint means permitting said conduit one end to pivot around horizontal and vertical axes for allowing translation of said discharge orifice along a complex path.

37. The apparatus of claim 33 wherein said mounting means includes a bushing defining an inner bore; and wherein said conduit includes a peripheral wall and wherein the portion thereof surrounding said supply orifice is accommodated in said bushing bore for rotation therein.

38. The apparatus of claim 37 wherein said mounting means further includes support means defining a rotational axis aligned with said supply orifice axis for supporting said conduit proximate to said second end.

39. Hydrotherapy apparatus for use in a water tub for discharging a water stream beneath the surface of a water pool in said tub for impacting against and massaging an area of a user's body, said apparatus comprising:

supply means for discharging a water jet along a defined axis;

an elongated rigid conduit including a tubular supply section having a supply orifice, a tubular discharge section having a discharge orifice and a tubular intermediate section coupling said supply section to said discharge section;

means mounting said conduit with said supply orifice substantially aligned with the axis of said water jet whereby water from said jet will flow through said conduit to said discharge orifice;

said mounting means including means supporting said conduit supply section for rotation about said supply section axis;

said intermediate section having an axis which deviates by an acute angle from the axis of said supply section;

said discharge section having an axis which deviates by an acute angle from the plane defined by the axes of said supply and intermediate sections;

whereby water is discharged from said discharge orifice in a direction including a thrust component for rotating said conduit around said supply section axis to translate said discharge orifice along a circular path.

40. The apparatus of claim 39 in combination with a water tub having a peripheral wall;

means mounting said apparatus in a first opening in said peripheral wall with said conduit oriented so that water discharged through said discharge orifice flows into said tub.

41. The apparatus of claim 40 including a second opening in said peripheral wall;

pump means having a suction side and a pressure side; and means coupling said pump means suction side to said second opening and said pressure side to said supply means for discharging a water jet.

42. The apparatus of claim 39 including:

a bushing having a substantially cylindrical bore fixedly mounted along said water jet axis; and wherein said conduit supply section is accommodated in said bushing bore for rotation therein about said supply section axis.

* * * * *